US006807745B2

(12) United States Patent
Orton

(10) Patent No.: US 6,807,745 B2
(45) Date of Patent: Oct. 26, 2004

(54) BEAM ALIGNMENT AND BRACING APPARATUS AND METHOD FOR MAKING SURE

(76) Inventor: Mark B. Orton, 2425 Eastlake Blvd., Washoe Valley, NV (US) 89704

( * ) Notice: Subject to any disclaimer, the term of this patent is extended or adjusted under 35 U.S.C. 154(b) by 0 days.

(21) Appl. No.: 10/154,248

(22) Filed: May 22, 2002

(65) Prior Publication Data

US 2002/0174557 A1 Nov. 28, 2002

Related U.S. Application Data

(60) Provisional application No. 60/293,383, filed on May 23, 2001.

(51) Int. Cl.[7] ..... G01D 21/00

(52) U.S. Cl. ..... 33/613

(58) Field of Search ..... 33/613–626, 645–647, 33/483, 487, 486, 494, 1 F, 1 G, 416, 562

(56) References Cited

U.S. PATENT DOCUMENTS

| | | | | | |
|---|---|---|---|---|---|
| 1,549,671 | A | * | 8/1925 | Kridler et al. | 33/613 |
| 1,665,400 | A | | 4/1928 | Bittner | |
| 2,659,980 | A | | 11/1953 | Dunn | 33/174 |
| 2,686,959 | A | | 8/1954 | Robinson | 29/285 |
| 3,406,460 | A | | 10/1968 | Colwell | 33/189 |
| 4,322,064 | A | * | 3/1982 | Jarvis | 33/613 |
| 4,520,571 | A | | 6/1985 | Harding | 33/189 |
| 4,843,726 | A | | 7/1989 | Ward | 33/613 |
| 4,942,670 | A | | 7/1990 | Brandt | 33/494 |
| D314,520 | S | | 2/1991 | Hass | D10/64 |
| 5,048,702 | A | * | 9/1991 | Maloney | 211/194 |
| 5,161,345 | A | | 11/1992 | Sobjack, Sr. | 52/652 |
| 5,239,762 | A | | 8/1993 | Grizzell | 33/474 |
| 5,367,783 | A | | 11/1994 | Nygren | 33/613 |
| 5,375,339 | A | | 12/1994 | Noel, Jr. | 33/518 |
| 5,390,422 | A | * | 2/1995 | Hill | 33/412 |
| 5,575,074 | A | | 11/1996 | Cottongim et al. | 33/474 |
| 5,669,149 | A | | 9/1997 | Meitzler | 33/471 |
| 5,687,539 | A | | 11/1997 | Bond | 52/748.1 |
| 5,727,325 | A | | 3/1998 | Mussell | 33/429 |
| 5,884,411 | A | | 3/1999 | Raber | 33/613 |
| 5,996,290 | A | | 12/1999 | Bond | 52/105 |
| 6,052,912 | A | * | 4/2000 | May | 33/645 |
| 6,289,594 | B1 | | 9/2001 | Wrobbel | 33/42 |
| 6,293,028 | B1 | | 9/2001 | Sylvia | 33/613 |
| 6,354,055 | B1 | * | 3/2002 | Shaw et al. | 52/712 |
| 6,374,558 | B1 | * | 4/2002 | Surowiecki | 52/241 |
| 6,471,175 | B1 | * | 10/2002 | Kratish et al. | 248/466 |

* cited by examiner

*Primary Examiner*—Christopher W. Fulton
(74) *Attorney, Agent, or Firm*—Kunzler & Associates

(57) ABSTRACT

Disclosed is an alignment guide and a method for beam aligning and bracing. The alignment guide of the present invention comprises alignment tabs punched into a commonly available spacing rail. The alignment guide is lightweight and economical. A plurality of alignment guides may be stacked for ease of transportation. The method comprises supporting a first beam and receiving the first beam and a plurality of beams to be spaced into the space formed by the alignment tabs. The beams are supported and spaced by the alignment guide until they have been fastened into place. Also disclosed is an apparatus for the manufacture of the alignment guide with which alignment tabs are economically punched into a commonly available prefabricated spacing rail.

20 Claims, 8 Drawing Sheets

BEAM ALIGNMENT AND BRACING APPARATUS AND METHOD FOR MAKING SURE

RELATED INVENTIONS

This application is a continuation-in-part of and claims priority to U.S. provisional patent application Ser. No. 60/293,383 entitled Beam Alignment and Bracing Apparatus and Apparatus for Making Same, which was filed on May 23, 2001.

BACKGROUND OF THE INVENTION

1. The Field of the Invention

The invention relates to alignment tools and more specifically, to systems and methods of aligning beam systems. In particular, the invention is directed to aligning, spacing, and supporting truss and stud systems.

2. The Relevant Art

Trusses for building construction are generally fabricated off-site and then lifted into position upon framed walls. The trusses must be uniformly spaced and held in properly spaced vertical alignment while the roof decking is installed. Upon installation, the roof decking maintains the spatial alignment of the trusses.

A common residential construction method by which a truss system is assembled begins with individual truss units being shipped to the construction site. At the construction site walls are formed, and generally include an upper beam which supports the trusses. The truss units are placed upon the supporting beams to span the distance between the walls. A plurality of truss units is placed in a row with a selected spacing between trusses. Typical spacings are 12, 16, and 24 inches. The trusses should be accurately spaced from each other to provide uniform strength.

One difficulty with truss units is stabilizing and bracing the units after attachment to the supporting wall but before installation of the roof decking. Truss units have a height dimension that is much greater than their width dimension. Therefore, trusses are prone to tipping, and care must be taken to avoid a "domino" effect.

Alignment and bracing tools have numerous applications in many fields, but are particularly important in construction applications such as truss installation. Many alignment tools are commonly available and come in many forms such as flexible tapes, and rigid poles.

One type of alignment and spacing tool of the prior art comprises a plurality of tool segments each of which is designed to extend between a pair of adjacent truss units. Each tool segment is configured to engage a surface of the truss unit. Rivets are provided to connect each tool unit, and permit adjacent tool members to pivot about each other, which allows the segments to fold up much like a foldable measuring stick. Disengaging a tool such as this for reuse is possible, but at times difficult. Alternative systems perform in a manner consistent with their design, but are expensive and are not compact and easily transported.

A need exists in the art for a spacing/bracing apparatus that is easy to use and that is simply and inexpensively manufactured. The present invention is directed to filling this previously unmet need.

OBJECTS AND BRIEF SUMMARY OF THE INVENTION

The alignment guide of the present invention has been developed in response to the present state of the art, and in particular, in response to the problems and needs in the art that have not yet been fully solved by currently available alignment guides. Accordingly, it is an overall object of the present invention to provide an alignment guide that overcomes many or all of the above-discussed shortcomings in the art. A method of use of the alignment guide, as well as a method and apparatus for making the alignment guide are also provided.

In one embodiment provided herein, the alignment guide comprises a top surface configured to adjoin a selected surface of a beam member and a plurality of alignment tabs protruding outward from the surface. The tabs are preferably spaced so that the beam is received against the top surface between the tabs. The tabs may be pointed to catch and hold the beam within two or more tabs.

The alignment tabs preferably protrude outward and may protrude in a direction substantially perpendicular to the top surface. Two or more of the alignment tabs may be configured to form a slot for receiving the beam member. In one embodiment, the alignment guide is formed from a lightweight rail of rolled U-channel metal. The U-channel is configured with a plurality of flanges disposed along the edges of the U-channel. The alignment tabs are stamped in pairs on the flanges with the distance between each tab corresponding to the selected thickness of the beam member.

One advantage of the alignment guide of the present invention is that the profile of the top portion of the alignment guide is receivable into the bottom portion such that a plurality of alignment guides may be stacked. Holes adjacent the alignment tabs allow the alignment tabs from a lower stacked alignment guide to protrude through the holes.

The alignment guide may be fabricated from a commonly available prefabricated member. A plurality of apertures may be formed in the alignment guide, through which a fastener can pass for fastening the alignment guide to the beam member. Under a preferred embodiment of the present invention, the alignment tabs are configured to be disengageable for reuse.

In order to use the alignment guide of the present invention, a first beam is secured manually in place. The first beam and an unsecured second beam are then received into the respective slots formed by the alignment tabs. Fasteners such as nails may be passed through openings in the alignment guide to temporarily fasten the engagement guide to the beams. Once the beams are secured in place, the alignment guide may be disengaged for reuse.

The alignment guide of the present invention may be configured to align a truss system wherein the truss system comprises at least a first and a second truss unit. Alternatively, the alignment guide may be configured to align a stud system wherein the stud system comprises at least a first and a second stud unit.

Under a preferred embodiment of the present invention, an apparatus for fabricating an alignment guide comprises a press, a head frame adjoining the press, and a plurality of cutter prongs vertically disposed along the head frame. Also provided are a plurality of push rods disposed along the head frame, a plurality of guide assemblies disposed at first and second ends of the head frame, an anvil disposed parallel to and below the head frame, and a plurality of immobile guide posts disposed at each end of the anvil.

In one embodiment, the press comprises a hydraulic press. The press may be a commonly available hydraulic log splitter. The anvil may comprise an I-beam. The position and separation of the plurality of cutter prongs is preferably adjustable. The plurality of cutter prongs may comprise pairs of cutter prongs with a separation configured to receive a beam. The separation of pairs of cutter prongs is in one embodiment approximately 1⅝ inches. The separation between pairs of cutter prongs is approximately 24 inches. The push rods are preferably configured to be immobile and are used to remove the alignment guide from the head frame.

The method of fabricating an alignment guide comprises providing a press, placing a commonly available prefabricated member in the press, and punching a plurality of alignment tabs into the prefabricated member within the press.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the advantages and objects of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
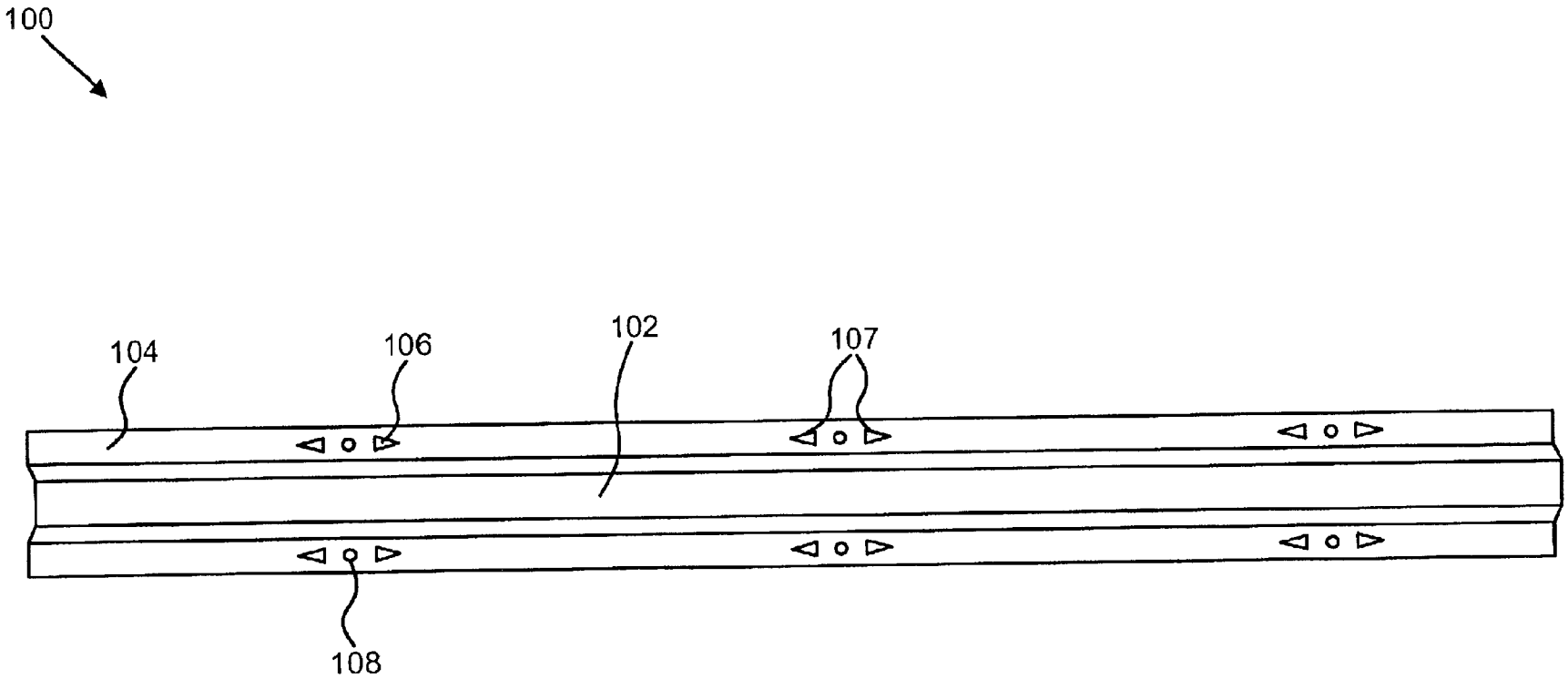
FIG. 1 is a top view of an alignment guide of the present invention.

FIG. 1 shows a top view of the alignment guide 100 of the present invention. The alignment guide 100 is quite simple, and its simplicity is one of it advantages. The alignment guide 100 comprises a spacer rail 102 consisting of lengths of rolled metal channel, sometimes referred to as U-channel but more properly referred to as "hat" channel. Under a preferred embodiment of the present invention, the spacer rail 102 has a length of approximately 10 feet. The spacer rail 102 is a lightweight metal strip rolled into a U-shape cross section to provide a moment of inertia against bending. Thus, the channel is preferably rigid against bending.

The spacer rail 102 has a plurality of flanges 104 disposed along the edges (at the tips of the "U"). In one embodiment, triangular-shaped tabs 106 are punched out of the flanges 104 and bent outward. The tabs 106 may be pointed to catch the beams between two or more tabs 106. The tabs 106 are preferably stamped in pairs, with the distance between each tab in a pair corresponding to the thickness of a beam member (in one embodiment, about 1½ to 1¾ inches for a truss made from 2×6 lumber). Alternatively, the distance between pairs of tabs 106 may be configured to receive a beam member of any dimension.

The distance between adjacent tab 106 pairs corresponds to the desired distance between trusses. Typically this distance is approximately 12, 16, or 24 inches. Thus, the alignment guide 100 of the present invention is used to align trusses by receiving a truss between the tabs 106 in each pair of tabs (one tab on each side of the truss, in very close adjacency thereto). In one embodiment, a pre-drilled aperture 108 is supplied between the tabs 106 of each pair, so that a single (e.g. double-headed) nail can be driven through the spacer rail 10- and into the truss. This temporarily secures the channel to the truss.

Apertures 108 provide for optimal placing and easy driving of nails. Alternatively, nails can be driven directly through the flanges 104. Under a preferred embodiment of the present invention, the alignment guide 100 typically is ten feet long, about 2⅞ inches wide, and ⅞ inches high. The punched tabs 104 are preferably spaced to receive 2-inch lumber, such as "two by fours" or "two by sixes," from which trusses typically are constructed. In one embodiment, a distance of approximately 24 inches separates the tab pairs 107. Alternatively, the distance between tab pairs 107 may correspond to the selected center-to-center separation distance of the trusses. Once the truss is placed between the tabs, a duplex nail may be driven, either through the nail hole 108 or directly through the flange 104 between the tab pairs 107, and into the truss.

Figure 2A:
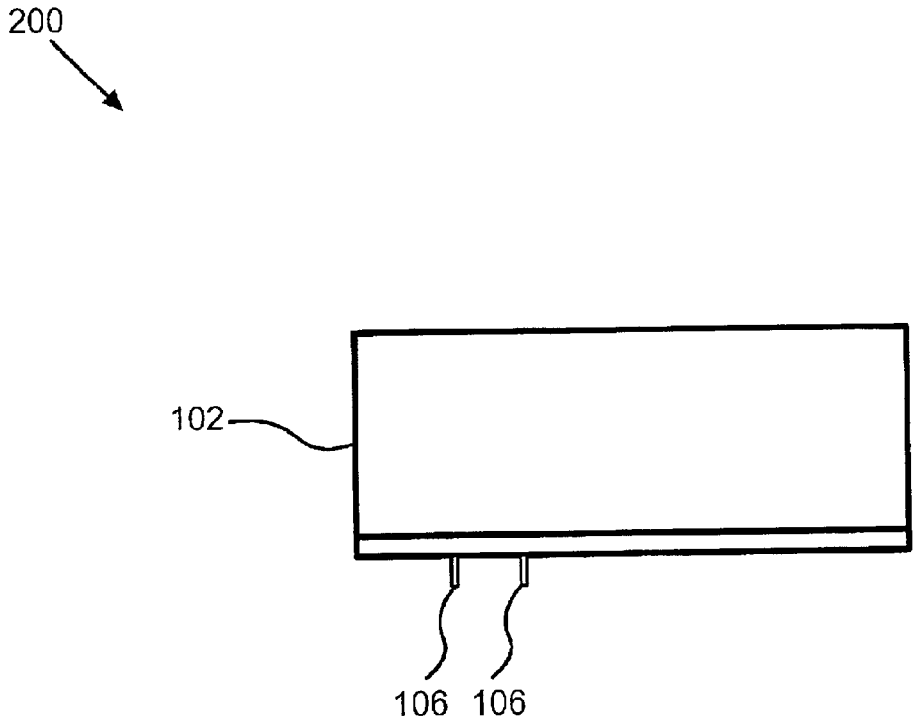
FIG. 2*a* is a side view of the alignment guide of FIG. 1.
Figure 2B:
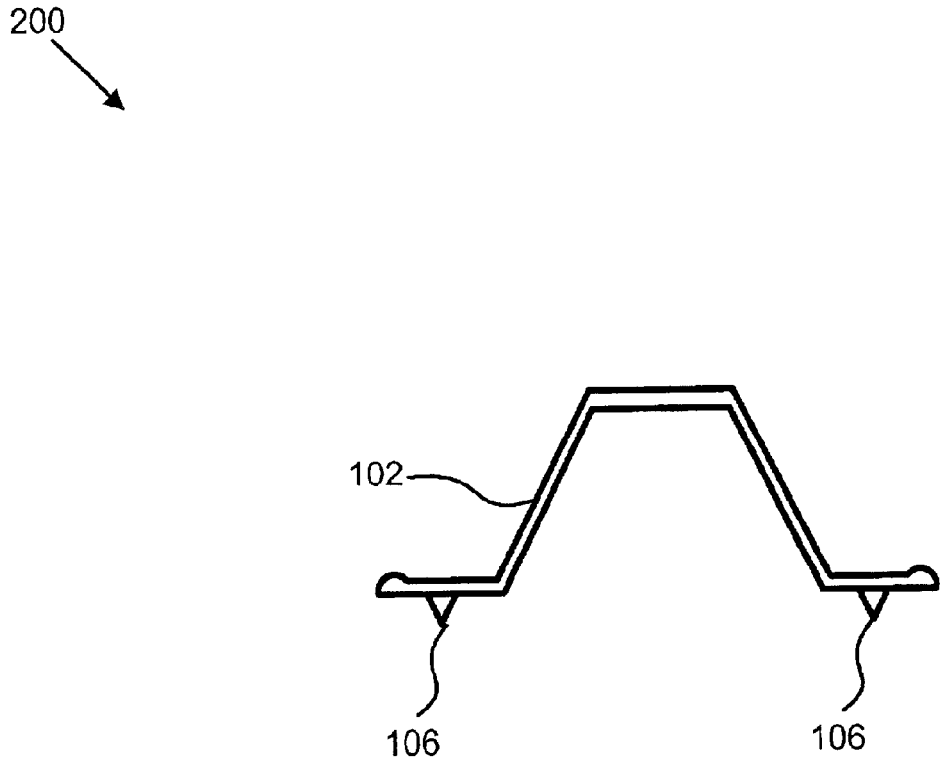
FIG. 2*b* is an end view of the alignment guide of FIG. 1.
Figure 3:
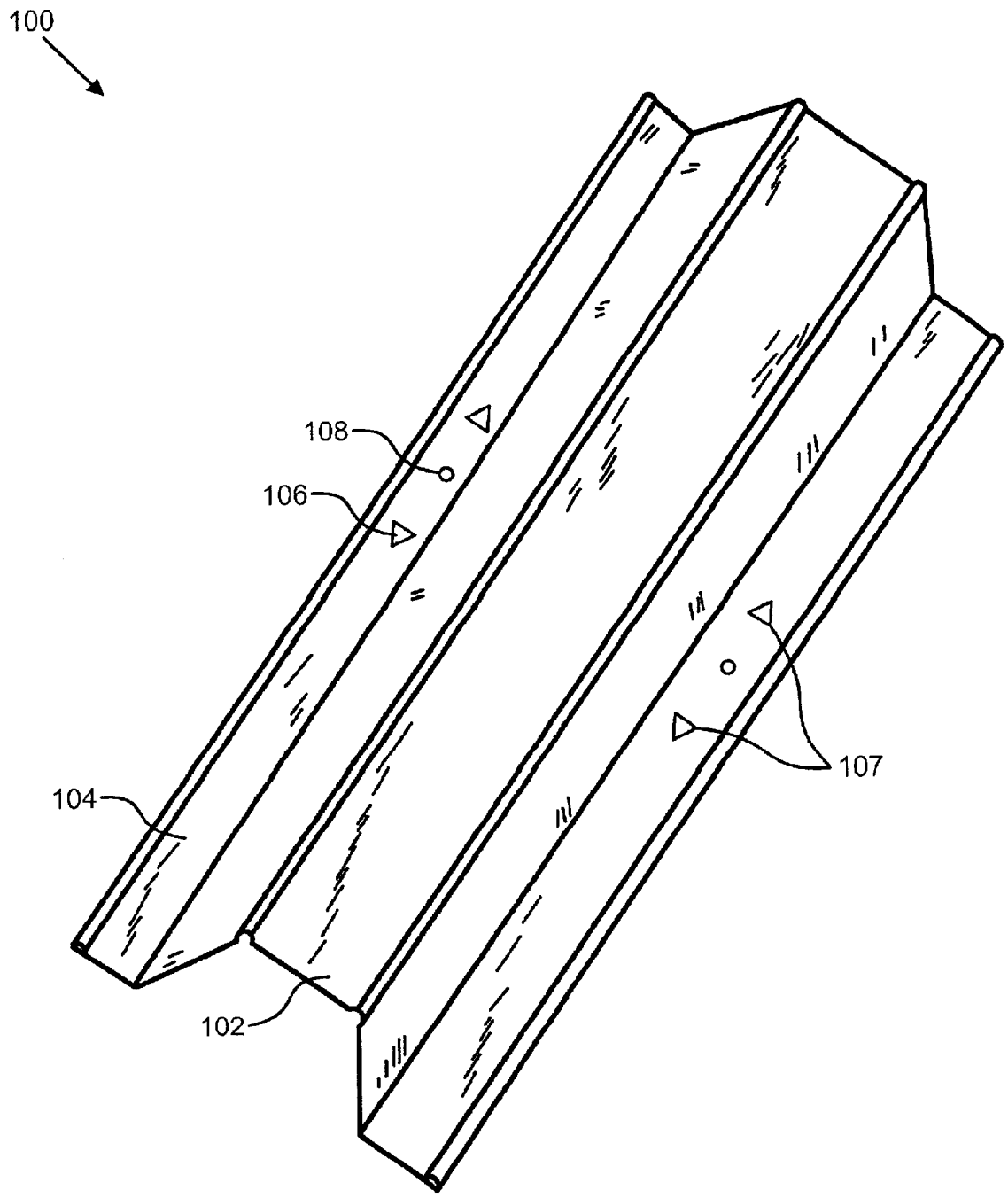
FIG. 3 is a perspective view of the alignment guide of FIG. 1.

Referring jointly now to FIGS. 2*a*, 2*b*, and 3, shown therein is a side elevation, an end sectional elevation, and an enlarged perspective view of a short section 200 of the alignment guide 100 of FIG. 1. The punched tabs 106 are typically spaced to receive 210 inch lumber, such as "two by fours" or "two by sixes," from which trusses are commonly constructed.

Figure 4:
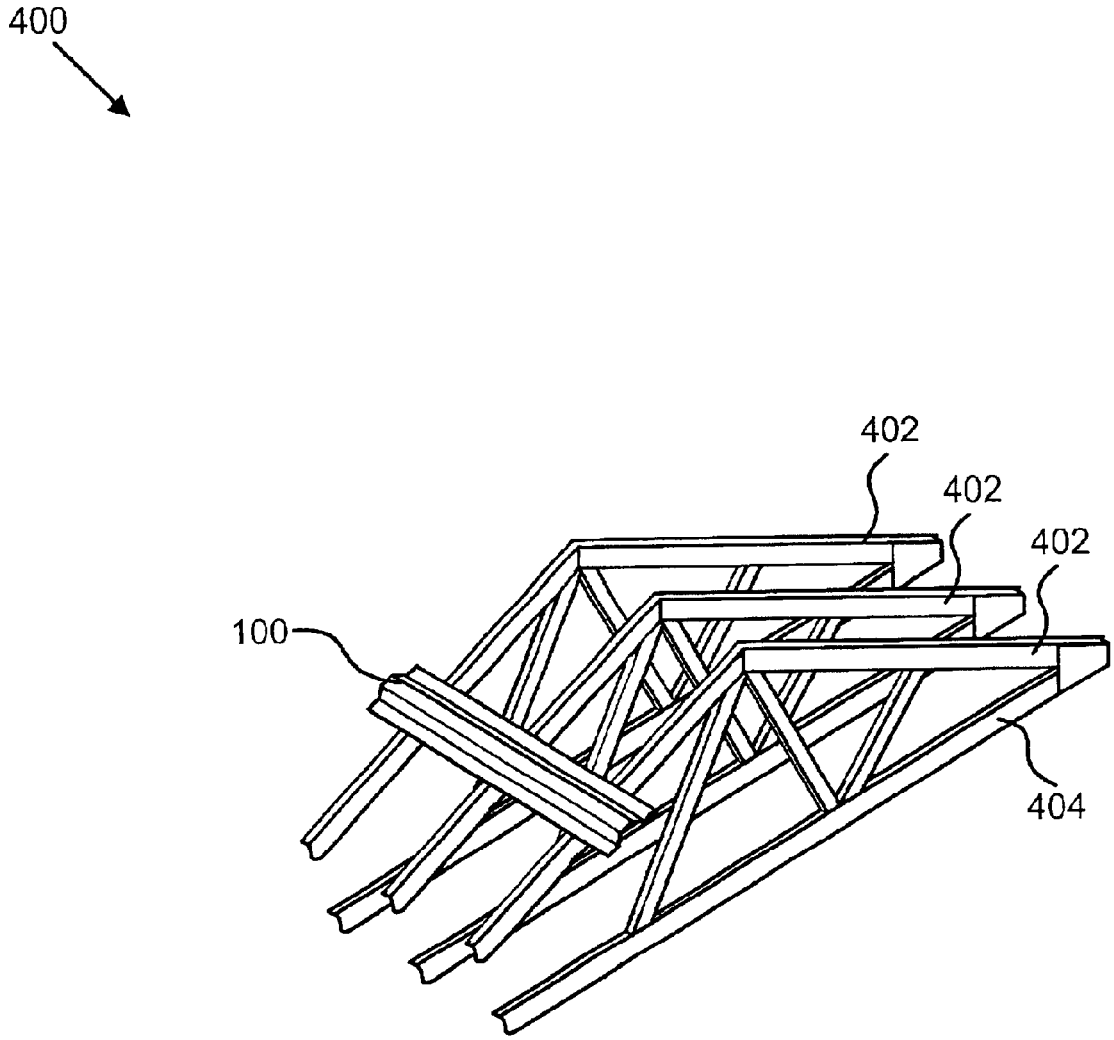
FIG. 4 is a perspective view of implementation of the alignment guide of FIG. 1.

Referring now to FIG. 4, shown therein is one example of a manner of implementing the alignment guide 100 of the present invention. The alignment guide 100 is configured to receive the top surface of a truss 402 and set the spacing between a plurality of roof trusses 402. Of course, this is only one of the many applications of the present invention. The alignment guide 100 may be cut to any length using common tools such as tin snips. Therefore, the alignment guide 100 may be modified to span any distance less than the length of the alignment guide 100. The flange edges 104 may also be cut, and the top plane or spine of the alignment guide 100 bent, so that the bottom chord 404 of the truss 402 may be aligned. This is required when the trusses 402 are assembled in a non-standard manner.

Figure 5:
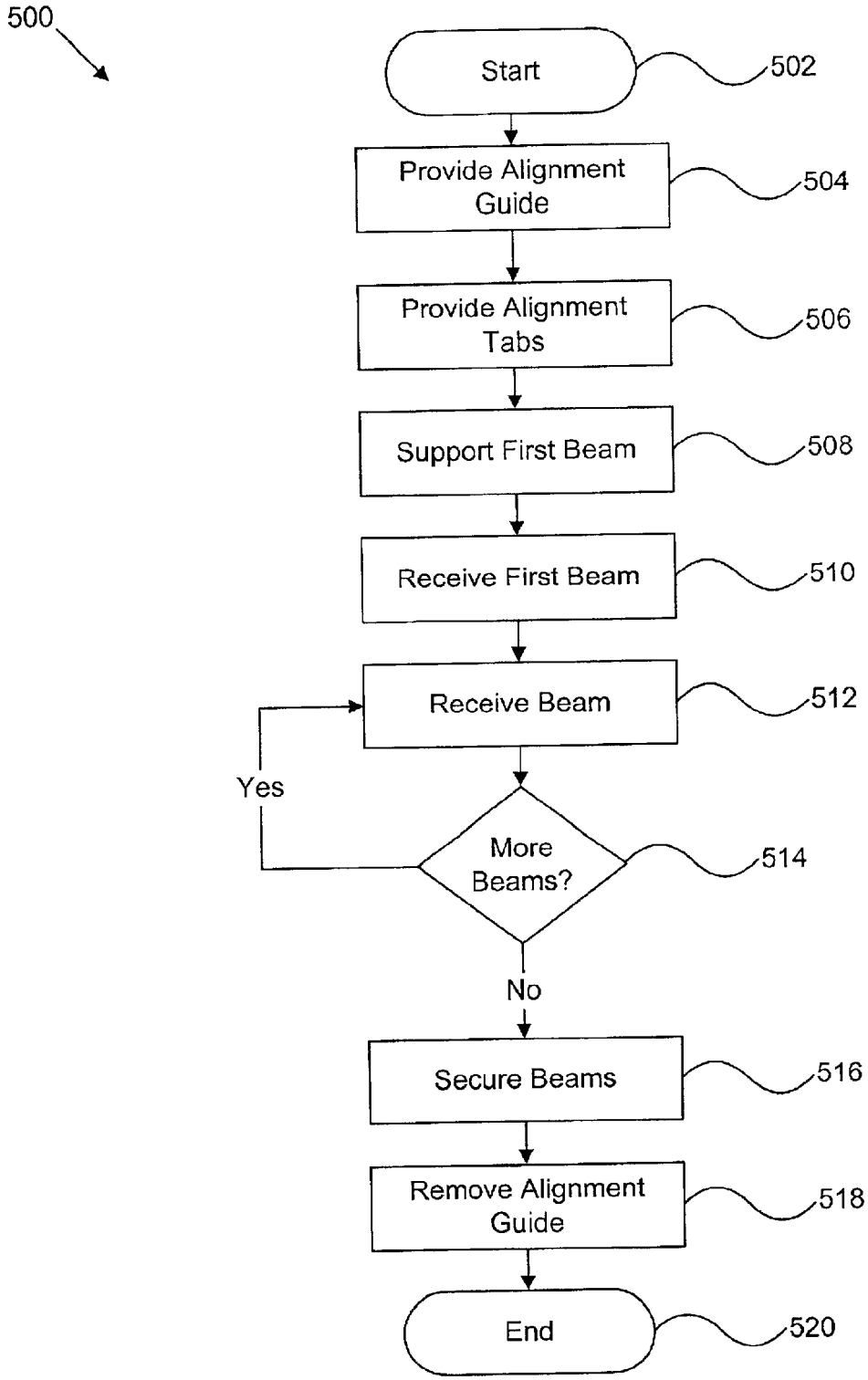
FIG. 5 is a schematic flow chart diagram illustrating one embodiment of a method for aligning a beam system of the present invention.

FIG. 5 shows a schematic block diagram illustrating a method 500 of using the alignment guide 100 of the present invention. The method 500 starts and an alignment guide 100 is provided 504. The alignment guide 100 is preferably configured as described above. In so doing, alignment tabs 106 are formed in the alignment guide 100. One method of fabricating the alignment guide 100 and tabs 106 will be discussed with greater detail below with reference to FIG. 8. Typically, the first beam is supported 508 on the building structure by conventional fastening means. Thereafter the alignment guide 100 receives the first beam 510.

After the first beam is supported 508, and the separation distance between beams is determined, the alignment guide 100 receives the next beam 512. If there are additional beams 514, then the alignment guide 100 receives 512 the beams. As a plurality of trusses is fitted between tabs and nailed, the alignment guide 100 holds the trusses in spaced relation while they are permanently attached to the framing. Alternatively, the beams are secured 516, and the alignment guide 100 is removed 518. Thus, the alignment guide 100 may be removed for reuse or left permanently in place according to the preference of the user.

Figure 6:
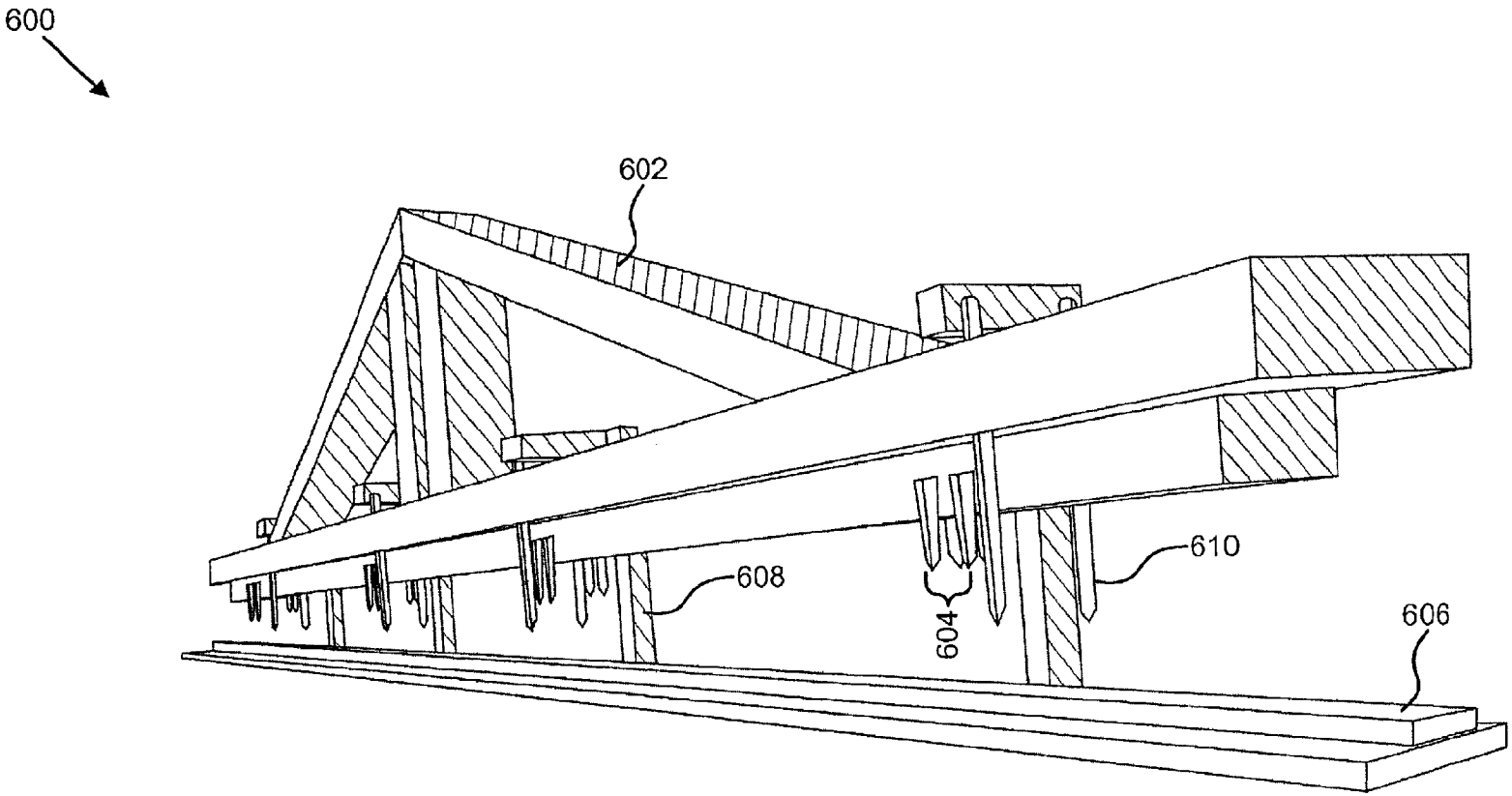
FIG. 6 is a perspective view of a fabricating press of the present invention.

FIG. 6 is a perspective view of an apparatus 600 for the fabrication of an alignment guide such as the alignment guide 100. A head frame assembly 602 is connected to a driven "ram" (not shown). The head frame assembly 602 is a long beam mounting with appropriately located pairs of vertically disposed cutter prongs 604. The head frame assembly 602 is pressed downward to force the cutting prongs 604 through the flanges 104 of the alignment guide 100. Disposed parallel to and below the head frame assembly 602 is an anvil 606 having a corresponding length upon which the spacer rail 102 is supported during the tab punching step. The apparatus 600 may be driven by a commonly available hydraulic press such as log splitter.

Also seen in FIG. 6 is a plurality of horizontal tubular frames 608, connected to the anvil 606, with rods 610 depending downward therefrom. The rods 610 serve as immobile push rods that push the alignment guide 100 off the head frame assembly 602 after the punching step has occurred. Once the cutter prongs 604 have perforated the flanges of the rail 102, the press section is raised from the anvil 606. Ordinarily, the cutter prongs 604 remain frictionally engaged in the holes perforated in the flanges 104. However, once the alignment guide 100 reaches a predetermined height, the alignment guide 100 comes in contact with the bottom ends of the rods 610; continued upward movement of the head frame assembly 602, and contact with the immobile rods 610, causes the perforated alignment guide 100 to be pushed off the cutting prongs 604.

Figure 7:
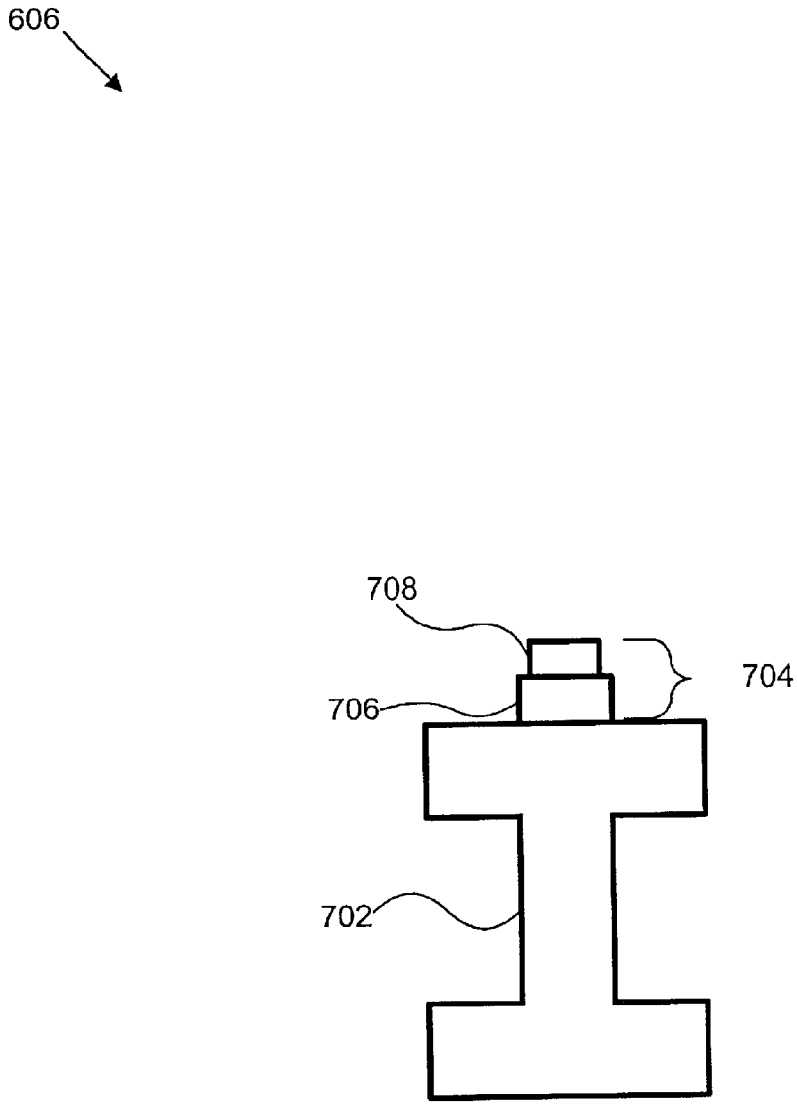
FIG. 7 is an end view of an anvil of the fabricating press of FIG. 6.

FIG. 7 shows an end view of a preferred embodiment of the anvil 606. The body of the anvil 606 may be fashioned from a length of I-beam 702. Under a preferred embodiment of the present invention, the I-beam is approximately 6 inches high and 4 inches wide. Disposed centrally upon the top surface of the upper flange of the I-beam 702, axially along its length, is a supporting block 704 having a stacked configuration. In one embodiment, the supporting block 704 is made from a first 706 and a second 708 bar stock member. The first bar stock member 706 preferably has dimensions of ⅜ inch by 1½ inch. The first bar stock 706 may be welded to the I-beam 702.

In one embodiment, the second bar stock 708 has dimensions of ⅜ inch by 1¼. The second bar stock 708 is preferably welded parallel to and upon the first bar stock 706. The second bar stock 708 forms the portion of the supporting block 704 that is disposable within the interior recess of the spacer rail 102. The second bar stock 708 supports the spacer rail 102 and prevents a collapse of the spacer rail 102. The wider first bar stock 706 offers support to the laterally extending flanges 104. During operation of the head frame assembly 602, the spacer rail 102 is placed concave side down upon the supporting block 704 and held while the cutter prongs 604 are pressed through the flanges 104 of the spacer rail 102.

Figure 8:
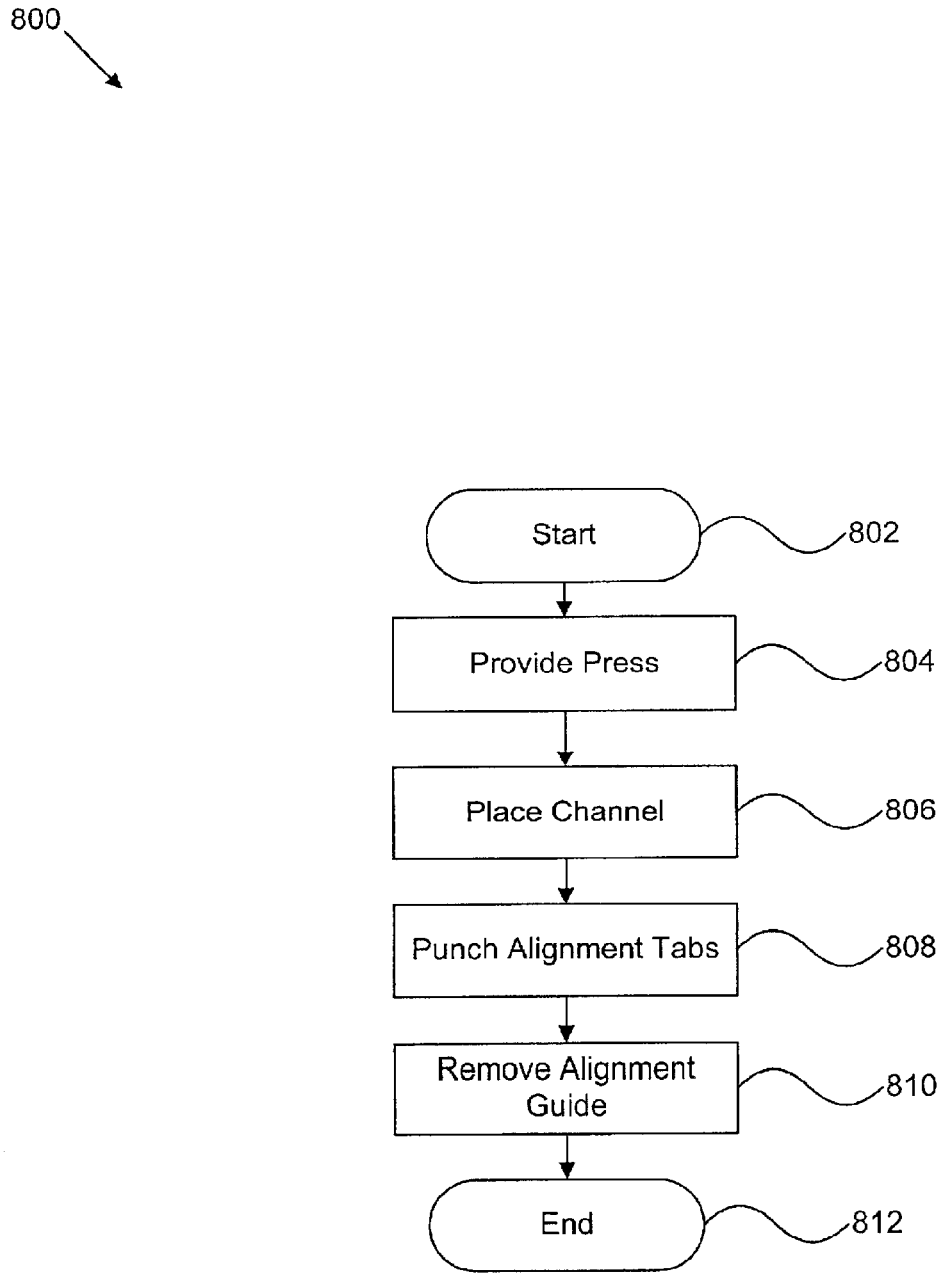
FIG. 8 is a schematic flow chart diagram illustrating one embodiment of a method for fabricating an alignment guide of the present invention.

FIG. 8 shows a schematic block diagram illustrating a method 800 of fabricating the alignment guide 100 of the present invention. The method 800 starts and a press is provided 804. A length of spacer rail 102 is placed 806 upon the anvil 606. The head frame assembly 602 is lowered and the alignment tabs 106 are punched 808. The alignment guide 100 is then removed 810 and the method ends 812.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An alignment guide for aligning building beam members, comprising:

a top surface configured to adjoin at least three beam members; and a plurality of alignment tabs protruding outward from the top surface to accommodate the at least three beam members, each alignment tab adjacent a hole that is positioned in the top surface, the hole having an area and shape substantially equal to the area and shape of the alignment tab; and a plurality of slots, each slot positioned between a pair of alignment tabs, and having a width substantially equal to a width of one of the beam members, each in order to receive one of the beam members in the slot.

2. The alignment guide of claim 1, wherein the plurality of alignment tabs protrudes outward substantially perpendicular to the top surface.

3. The alignment guide of claim 1, wherein the slots are spaced along the length of the alignment guide at more than one predetermined distance.

4. The alignment guide of claim 3, wherein the slots are spaced apart at approximately 12 inches, 18 inches, and 24 inches.

5. The alignment guide of claim 1, wherein the top surface is formed on a lightweight rail.

6. The alignment guide of claim 5, wherein the lightweight rail comprises a length of rolled U-channel metal.

7. The alignment guide of claim 6, wherein the top surface comprises a plurality of flanges disposed along the edges of the U-channel.

8. The alignment guide of claim 7, wherein the plurality of alignment tabs are stamped in pairs on the top surface with the distance between each tab corresponding to the selected thickness of the beam member.

9. The alignment guide of claim 7, wherein the profile of the top portion is receivable into the bottom portion such that a plurality of alignment guides may be stacked.

10. The alignment guide of claim 7, further comprising holes adjacent the alignment tabs such that alignment tabs from a lower stacked alignment guide protrude through the holes.

11. The alignment guide of claim 1, wherein the alignment guide comprises a commonly available prefabricated member stamped with the plurality of alignment tabs.

12. The alignment guide of claim 1, further comprising a plurality of apertures through which a fastener can pass for fastening the alignment guide to the beam member.

13. The alignment guide of claim 1, wherein the alignment tabs are configured to be disengageable for reuse.

14. The alignment guide of claim 1, further comprising fastening holes in the top surface for securing the alignment guide to at least one of the beam members.

15. The alignment guide of claim 14, wherein the holes created by the alignment tabs are the fastening holes, and wherein the fastening holes are positioned within the dimensions of the slot positioned between the punched alignment tabs.

16. A method for aligning beams members using an alignment guide, comprising:

providing an alignment guide having a top surface configured to adjoin at least three beam members;

providing a plurality of alignment tabs protruding outward from the too surface to accommodate the at least three beam members, each alignment tab adjacent a hole that is positioned in the top surface, the hole having an area and shape substantially equal to the area and shape of the alignment tab;

providing a plurality of slots each slot positioned between a pair of alignment tabs and having a width substantially equal to a width of one of the beam members, in order to receive one of the beam members;

receiving the beam members into the selected slots formed by the alignment tabs; and securing the beam members into position.

17. The method of claim 16, further comprising disengaging the alignment guide.

18. The method of claim 16, further comprising the step of aligning a truss system wherein the truss system comprises at least three truss members.

19. The method of claim 16, further comprising the step of aligning a stud system wherein the stud system comprises at least three stud members.

20. The method of claim 16, wherein the slots are spaced along the length of the alignment guide at more than one predetermined distance.

* * * * *

UNITED STATES PATENT AND TRADEMARK OFFICE

CERTIFICATE OF CORRECTION

PATENT NO. : 6,807,745 B2
DATED : October 26, 2004
INVENTOR(S) : Mark Orton

It is certified that error appears in the above-identified patent and that said Letters Patent is hereby corrected as shown below:

Title page,
Item [54], Title, "BEAM ALIGNMENT AND BRACING APPARATUS AND METHOD FOR MAKING SURE" should read -- BEAM ALIGNMENT AND BRACING APPARATUS AND METHOD FOR MAKING SAME --

Column 4,
Line 18, "spacer rail 10- and" should read -- spacer rail 102 and --

Column 5,
Line 24, "such as log splitter" should read -- such as a log splitter --

Column 6,
Line 27, "members, each in order" should read -- members, in order --

Column 7,
Line 4, "aligning beams members" should read -- aligning beam members --
Line 9, "from the too surface" should read -- from the surface --

Signed and Sealed this

Eighth Day of February, 2005

JON W. DUDAS
*Director of the United States Patent and Trademark Office*